US006401733B1

(12) United States Patent
Schrott et al.

(10) Patent No.: US 6,401,733 B1
(45) Date of Patent: Jun. 11, 2002

(54) DISPENSER FOR A DISHWASHER

(75) Inventors: Harald Schrott, Lindau; Guenter Biechele, Leutkirch, both of (DE)

(73) Assignee: Aweco Appliance Systems GmbH & Co. KG, Neukirch (DE)

( * ) Notice: Subject to any disclaimer, the term of this patent is extended or adjusted under 35 U.S.C. 154(b) by 70 days.

(21) Appl. No.: 09/583,528

(22) Filed: Jun. 1, 2000

(30) Foreign Application Priority Data

Jun. 1, 1999 (DE) ..... 199 24 897

(51) Int. Cl.[7] ..... B67D 3/00

(52) U.S. Cl. ..... 134/93; 134/6; 134/56 D; 134/57 D; 134/58 D; 134/137; 222/129

(58) Field of Search ..... 134/93, 56 D, 134/57 D, 58 D, 137, 166 R, 201, 6, 7; 222/129, 160, 504

(56) References Cited

U.S. PATENT DOCUMENTS 3,876,117 A * 4/1975 Wright et al. ..... 222/70
4,009,801 A * 3/1977 Williams ..... 222/70
4,149,654 A * 4/1979 Nelson et al. ..... 222/70
4,974,750 A * 12/1990 Welch ..... 222/129
5,186,912 A * 2/1993 Steindorf et al. ..... 422/263
5,884,821 A * 3/1999 Wilhelmstaetter et al. .. 222/511
6,189,551 B1 * 2/2001 Sargeant et al. ..... 134/200

* cited by examiner

*Primary Examiner*—Alexander Markoff
*Assistant Examiner*—Joseph Perrin
(74) *Attorney, Agent, or Firm*—Crowell & Moring LLP

(57) ABSTRACT

A dispenser for a dishwasher is proposed containing a housing 1 partially projecting in the installed condition through a door recess into the interior of the door of the automatic dishwasher and located partially within the wash area. The housing consists of two housing sections which preclude housing leaks into the interior of the door. This is achieved by providing an inner section located only partially within the interior of the door and projecting into the wash area, and an outer section located completely on the side of the wash area.

10 Claims, 1 Drawing Sheet

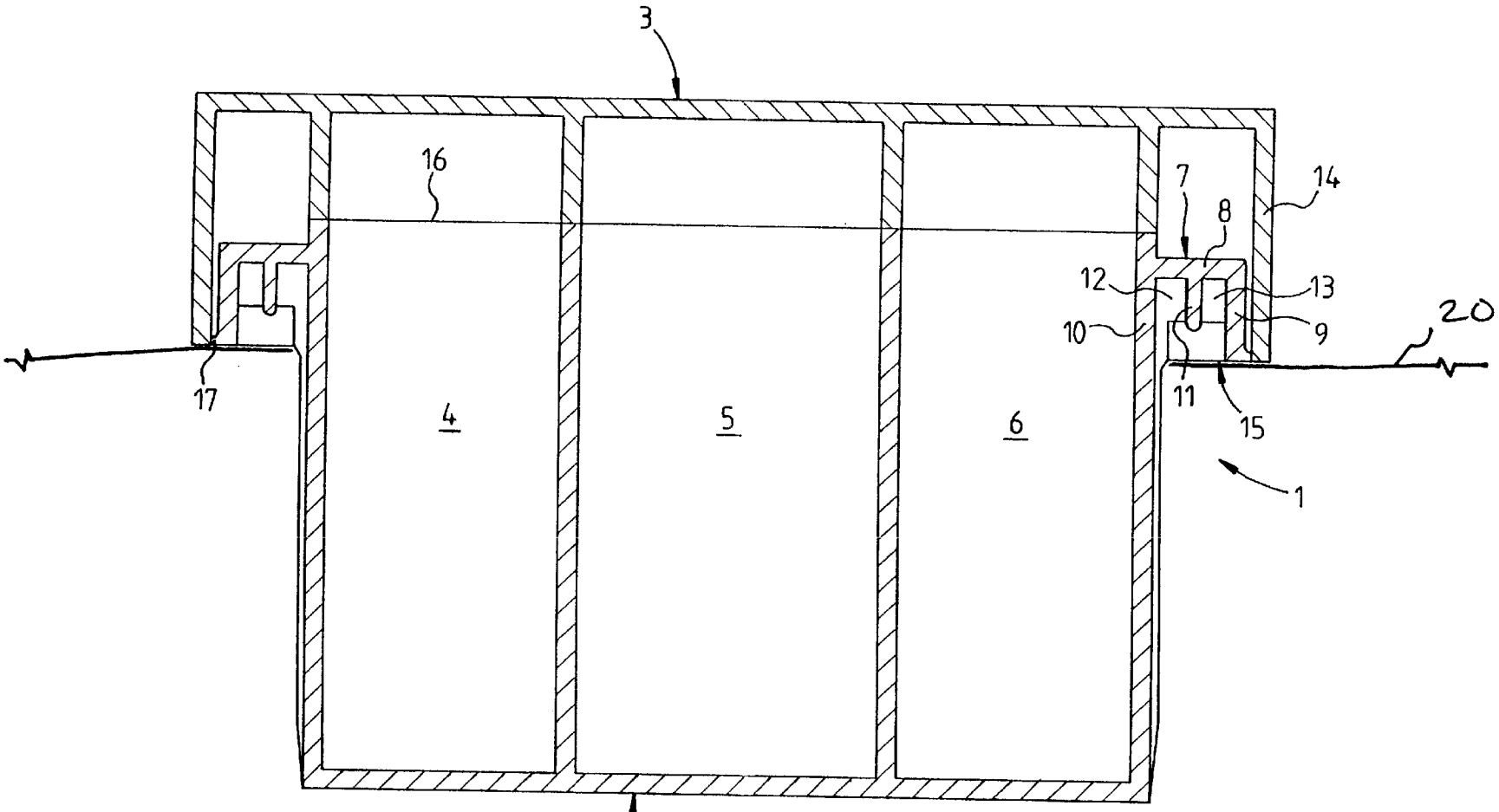
Fig.

DISPENSER FOR A DISHWASHER

BACKGROUND AND SUMMARY OF THE INVENTION

This application claims the priority of German Application No. 199 24 897.4, filed Jun. 1, 1999, the disclosure of which is expressly incorporated by reference herein.

The invention relates to a dispenser for a dishwasher, consisting of a housing projecting partially into the wash area and partially through a door recess into the interior of the door. The housing consists of at least two housing sections.

Commercially available dishwashers employ dispensers to supply wetting agents, while to dispense the dishwasher detergent during the wash program, inserts are used which are inserted through a recess of the inner panel of the dishwasher door and project inwards into the wash area. The dispensers include a housing, which is usually composed of at least two housing sections welded together. The outer section projects into the wash area of the dishwasher and extends through the recess into the interior of the door area. When installed, the inner section is located on the inside of the door and welded to the outer section.

This weld must be produced with great care in order to prevent leaks inside the door, which might allow the wetting agent to escape. Wetting agents present a not insignificant hazard for the insulation of the electrical wiring inside the door, especially that installed in the lower section.

The object of the invention is thus to propose a dispenser which precludes this hazard.

This object is achieved based on a dispenser for a dishwasher consisting of a housing projecting partially into the wash area and partially through a door recess into the interior of the door. The housing consists of at least two housing sections. Provision is made for an inner section projecting, in the installed condition of the dispenser, from the inside of the door into the wash area, and an outer section located completely on the side of the wash area. As a result, the location of the weld is shifted from the area of the inside of the door to the wash area, thereby completely precluding the leak hazard at the weld inside the door.

Advantageous embodiments of, and improvements to, the invention are described herein.

In one advantageous embodiment, a circumferential shoulder encompassing the inner section is provided for this purpose. The shoulder surrounds the rim of the recess through which the inner section, in the installed condition of the dispenser, projects into the interior of the door. This allows for a better seal of the joint between the dispenser and the inner panel of the door of the dishwasher.

In this shoulder, a groove is advantageously added into which a sealing element is inserted. With this sealing element inserted, a tightly sealed joint is thus created when the dispenser is inserted into the door recess.

On the outer section, a circumferential collar is advantageously provided which surrounds the circumferential shoulder of the inner section. First of all, this approach offers the possibility of a better design of the area visible during operation of the dishwasher, which area is formed completely by the outer section. Secondly, by additionally welding the circumferential collar of the outer section to the circumferential shoulder of the inner section, a second welded joint may be created such that both components are doubly welded to each other—with the result that the leak hazard is almost completely precluded even in the interior of the dishwasher.

It is advantageous to locate at least one functional element in the inner section. The greater the proportion of technical functional elements located at the inner section, the less complex the design of the outer section becomes. In particular, locating almost all functional components in the inner section results in an outer section which may be designed free of technical constraints.

This approach first allows for the inexpensive fabrication of the outer section, and in turn contributes to a freely selectable design for the visible area of the dispenser formed by the outer section. In particular, for example, a specific outer section may be provided by the manufacturer of the dishwasher and joined to a technically identical inner section.

A solenoid for operation may be advantageously located as a functional element, for example in the inner section, for dispensing the wetting agent. Similarly, an actuating member may be advantageously provided for a dispensing valve for dispensing the wetting agent, which actuating member penetrates the inner section and is sealed with appropriate known sealing elements.

Similarly, in advantageous embodiments, the dispensing valve may be completely accommodated within the inner section, where a connecting channel is provided to an outlet opening for the wetting agent into the wash area, said outlet opening being located in the outer section.

Additionally, in an advantageous embodiment, the actuating member for opening a hinged cover of the detergent chamber may be accommodated in the inner section. The actuating member is usually designed so that it is actuated by the solenoid provided for the dispensing valve.

A coupling element is advantageously provided in a special embodiment which connects the actuating element in the inner section with the hinged door of the detergent chamber in the outer section. The coupling element may, for example, create the mechanical coupling via limit stops or via a detent mechanism with the result that when the inner section is joined to the outer section, no additional steps are necessary.

Other objects, advantages and novel features of the present invention will become apparent from the following detailed description of the invention when considered in conjunction with the accompanying drawings.

BRIEF DESCRIPTION OF THE DRAWINGS

The single FIGURE is a cross-sectional view through the housing of a dispenser according to the invention.

DETAILED DESCRIPTION OF THE DRAWINGS

The single FIGURE shows the housing 1 of a dispenser for a dishwasher consisting of an inner section 2 and an outer section 3. Housing 1 is divided into three chambers 4, 5, and 6, however, this three-part division is not absolutely necessary; on the contrary, any previously used shape for the housing may be employed.

Inner section 2 is provided with a circumferential shoulder 7 having an angled cross-section, a cross link 8 running transversely to the housing, and a rim section 9 running parallel to the housing panel. The intermediate space between the rim section 9 and outer panel 10 of the housing 1 is subdivided by an intermediate rib 11 into two circumferential grooves 12 and 13.

A sealing element may be inserted into at least one of grooves 12, 13. It is also conceivable to employ a sealing element filling the entire intermediate space between rim section 9 and outer panel 10, which sealing element exhibits an appropriate slot to accommodate intermediate rib 11.

Outer section 3 is provided with a collar 14 extending beyond shoulder 7. The collar 14 extends to the support area 15 of the dispenser at an inner panel of the dishwasher door 20. With the dispenser in the installed condition, only outer section 3 of housing 1 is thus visible.

Outer section 3 is welded to inner section 2 at welding plane 16. As is clearly seen in the illustration, welding plane 16 lies within inner section 2, which in turn is located within the interior of the wash area of the dishwasher and thus outside the interior of the door. Based on the sealing element (not shown) and shoulder 7, the spatial configuration is such, matching the seal to the door panel, that any leaks at welding plane 16 are simultaneously sealed along with inner section 2 vis-à-vis the door panel.

If needed, additional protection against leaks from the wash area at welding plane 16 may be achieved by a second weld point 17 at the edge of rim section 9 of shoulder 7, and in inner section 2, as well as at the edge of the over-extending collar 14 in the outer section.

Essentially, all technical functions of the dispenser may be integrated into inner section 2. In outer section 3, only the appropriate filler openings for the wetting agent and detergent need to be provided. For this purpose, there are almost no limits on the design of outer section 3 so that variously designed outer sections 3 may, for example, be combined with an identical inner section 2 containing the appropriate technical functions.

TABLE OF REFERENCE NUMBERS

1. Housing
2. Inner section
3. Outer section
4. Chamber
5. Chamber
6. Chamber
7. Shoulder
8. Cross link
9. Rim section
10. Outer panel
11. Intermediate rib
12. Groove
13. Groove
14. Collar
15. Support
16. Welding plane
17. Welding point The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A dispenser for a dishwasher, comprising:

a housing projecting partially into a wash area of the dishwasher and partially through a door recess into an interior of a door of the dishwasher;

wherein the housing comprises an inner section projecting in an installed condition of the dispenser from the interior of the door into the wash area and an outer section located completely on the side of the wash area wherein the inner section is joined with the outer section by a weld located completely on the side of the wash area.

2. The dispenser according to claim 1, wherein a circumferential shoulder is provided on the inner section.

3. The dispenser according to claim 2, wherein the shoulder exhibits at least one groove for a sealing element.

4. The dispenser according to claim 1, wherein a circumferential collar is provided for the outer section, which collar surrounds a shoulder of the inner section.

5. The dispenser according to claim 2, wherein a circumferential collar is provided for the outer section, which collar surrounds the shoulder of the inner section.

6. The dispenser according to claim 4, wherein a welding point is provided between the shoulder of the inner section and the collar of the outer section.

7. The dispenser according to claim 1, further comprising at least one functional element is located in the inner section.

8. The dispenser according to claim 1, wherein at least one of the following is located in the inner section: solenoid to actuate the dispenser, an actuating member for a dispensing valve, and a dispensing valve.

9. The dispenser according to claim 1, wherein an actuating member to open a hinged door of a dishwasher detergent chamber is provided in the inner section, a coupling element being provided between the actuating member and the hinged door of the dishwasher detergent chamber.

10. A method for producing a dispenser for a dishwasher, the method comprising the acts of:

providing an inner section of a housing of the dispenser that, in an installed condition, projects from an interior of a dishwasher door into a wash area;

providing an outer section of the housing that, in the installed condition, is completely outside the interior of the door; and welding said outer section to said inner section at a welding point that, in the installed condition, is located completely on the side of the wash area.

* * * * *